US007255621B2

(12) United States Patent
Deslauriers

(10) Patent No.: US 7,255,621 B2
(45) Date of Patent: Aug. 14, 2007

(54) PERSONAL FLOTATION DEVICE

(76) Inventor: Julien Pascal Deslauriers, PO Box 41, St-Sauveur-des-Monts, Québec (CA) J0R 1R0

( * ) Notice: Subject to any disclaimer, the term of this patent is extended or adjusted under 35 U.S.C. 154(b) by 0 days.

(21) Appl. No.: 11/148,361

(22) Filed: Jun. 9, 2005

(65) Prior Publication Data

US 2006/0281378 A1 Dec. 14, 2006

(51) Int. Cl.
*B63C 9/08* (2006.01)

(52) U.S. Cl. ..... 441/115

(58) Field of Classification Search ..... 441/113–119
See application file for complete search history.

(56) References Cited

U.S. PATENT DOCUMENTS 1,297,270 A * 3/1919 Stebbing ..... 441/118
3,181,183 A 5/1965 Allen
3,903,555 A 9/1975 Busby
3,956,786 A 5/1976 O'Link
4,038,713 A * 8/1977 O'Link ..... 441/112
4,193,153 A * 3/1980 Tyrer et al. ..... 441/118
4,655,718 A 4/1987 Lucius
4,871,338 A 10/1989 Hoffman
5,030,153 A 7/1991 Bailey
5,152,706 A * 10/1992 Fister ..... 441/106
5,588,892 A 12/1996 McMahon
5,766,114 A 6/1998 Campbell
5,775,967 A 7/1998 Lacoursiere et al.
5,951,348 A 9/1999 Liong et al.
6,062,929 A * 5/2000 Hallstrom ..... 441/106
6,447,353 B1 9/2002 Henry
6,527,480 B2 3/2003 Angelini et al.
6,537,119 B2 * 3/2003 Deslauriers ..... 441/106
6,554,668 B2 4/2003 Tanabe
6,558,082 B1 5/2003 Courtenay et al.
6,582,266 B1 6/2003 Steger et al.

* cited by examiner

*Primary Examiner*—Ed Swinehart
(74) *Attorney, Agent, or Firm*—Ogilvy Renault LLP

(57) ABSTRACT

A personal flotation device (PFD) comprises a front flotation portion overlaying an upper region of a wearer's chest and a rear flotation portion overlaying an upper region of the wearer's back. The front flotation portion is joined with the rear flotation portion along a transverse top edge of the PFD adapted to overlay shoulders of the wearer. A seat portion is adapted to extend between the wearer's legs and is substantially free of buoyant materials relative to the main flotation member. At least one fastening strap is releasably fastenable to retain the main flotation member in place on the wearer. A majority of buoyancy provided by the PFD is disposed above a horizontally extending reference axis which corresponds to a center of gravity of the wearer. At least one ballast weight may also be provided and is disposed below the reference axis.

30 Claims, 8 Drawing Sheets

PERSONAL FLOTATION DEVICE

TECHNICAL FIELD

The present invention relates generally to a personal flotation device, and more particularly to one adapted for use by infants.

BACKGROUND OF THE ART

Many life vests and personal flotation devices have been developed in the past, all of which generally have the same common purpose of keeping a wearer afloat in a body of water. However, many existing personal flotation devices are intended for, or at least best suited for use by, adults. Thus, many so-called children's personal flotation devices are often merely scaled-down versions of larger adult personal flotation devices, and therefore are not purpose designed for the needs for such small infants.

Some attempts have been made to provide a personal flotation device that is suited for children. For example, U.S. Pat. No. 3,956,786 issued May 18, 1976; U.S. Pat. No. 5,030,153 issued Jul. 9, 1991; U.S. Pat. No. 5,766,114 issued Jun. 16, 1998; U.S. Pat. No. 5,775,967 issued Jul. 7, 1998; U.S. Pat. No. 5,951,348 issued Sep. 14, 1999; U.S. Pat. No. 6,447,353 issued Sep. 10, 2002; and U.S. Pat. No. 6,582,266 issued Jun. 24, 2003, all disclose various personal flotation device designs intended for use by children. However, these designs all have various constraints and/or weaknesses for which improvement is desired.

Accordingly, an improved personal flotation device particularly suited to infants is sought.

SUMMARY OF THE INVENTION

It is therefore an object of this invention to provide an improved personal flotation device, particularly one suited for infants.

In one aspect, the present invention provides a personal flotation device comprising: a buoyant main flotation member including a flotation portion adapted to overlay an upper region of a wearer's chest and a rear flotation portion adapted to overlay an upper region of the wearer's back, said front flotation portion being joined with said rear flotation portion along a transverse top edge of the personal flotation device adapted to overlay shoulders of the wearer, a seat portion adapted to extend between the wearer's legs and having a fixed end thereof permanently engaged with one of said front and rear flotation portions at a remote end thereof and the seat portion having an opposed free end having fastening means thereon for removably fastening said free end to the other of said front and rear flotation portions at an opposed remote end thereof, the seat portion in a fastened configuration retaining the front and rear flotation portions adjacent the upper region of the wearer's chest and back respectively, the seat portion being substantially free of buoyant materials relative to said main flotation member; at least one fastening strap being releasably fastenable to retain the main flotation member in place on the wearer; and wherein a majority of buoyancy provided by said personal flotation device is disposed above a horizontally extending reference axis which corresponds to a center of gravity of the wearer.

In another aspect, the present invention provides a personal flotation device comprising a buoyant main flotation member fastenable to a user and including a rear flotation portion adapted to overlay an upper region of a wearer's back and a front flotation portion adapted to overlay an upper region of a wearer's chest, the rear flotation portion having lateral side portions spaced apart by a central portion, the lateral side portions producing a greater buoyancy than the central portion for stabilizing the personal flotation device in a lateral direction, the rear flotation portion and the front flotation portion respectively extending a first and a second distance away from a transversely extending top edge of the personal flotation device intermediately disposed between said front and rear flotation portions and adapted to overlay shoulders of the wearer, said rear flotation portion having a transversal width greater than that of said front flotation portion, said transversal width increasing from a remote end of said front flotation portion to an opposed remote end of said rear flotation portion.

Further details of these and other aspects of the present invention will be apparent from the detailed description and figures included below.

DESCRIPTION OF THE DRAWINGS

Reference is now made to the accompanying figures depicting aspects of the present invention, in which.

DETAILED DESCRIPTION OF THE PREFERRED EMBODIMENTS

The present invention relates generally to a personal flotation device (PFD), particularly one adapted and suited for infants, babies, and/or small children. Thus, the disclosed embodiment of the PFD of the present invention will be generally described herein as being worn by an "infant", however the term "infant" as used herein is defined as including small children, babies, toddlers, and the like. In a preferred embodiment, the PFD of the present invention is adapted to be worn by infants less than 2 years old, and can be even worn by infants less than one year old. The PFD device of the present invention is therefore adapted for use by infants up to about 40 lbs, and is also adapted for infants less than 15 lbs. However it is to be understood that a slightly scaled up or scaled down version could be similarly used to accommodate slightly older or younger children respectively. Thus, while the present invention was developed particularly for infants, a larger PFD could be provided for use by adult wearers without departing from the scope of the present invention. The term wearer is used herein to define any such user of the PFD.

Figure 1:
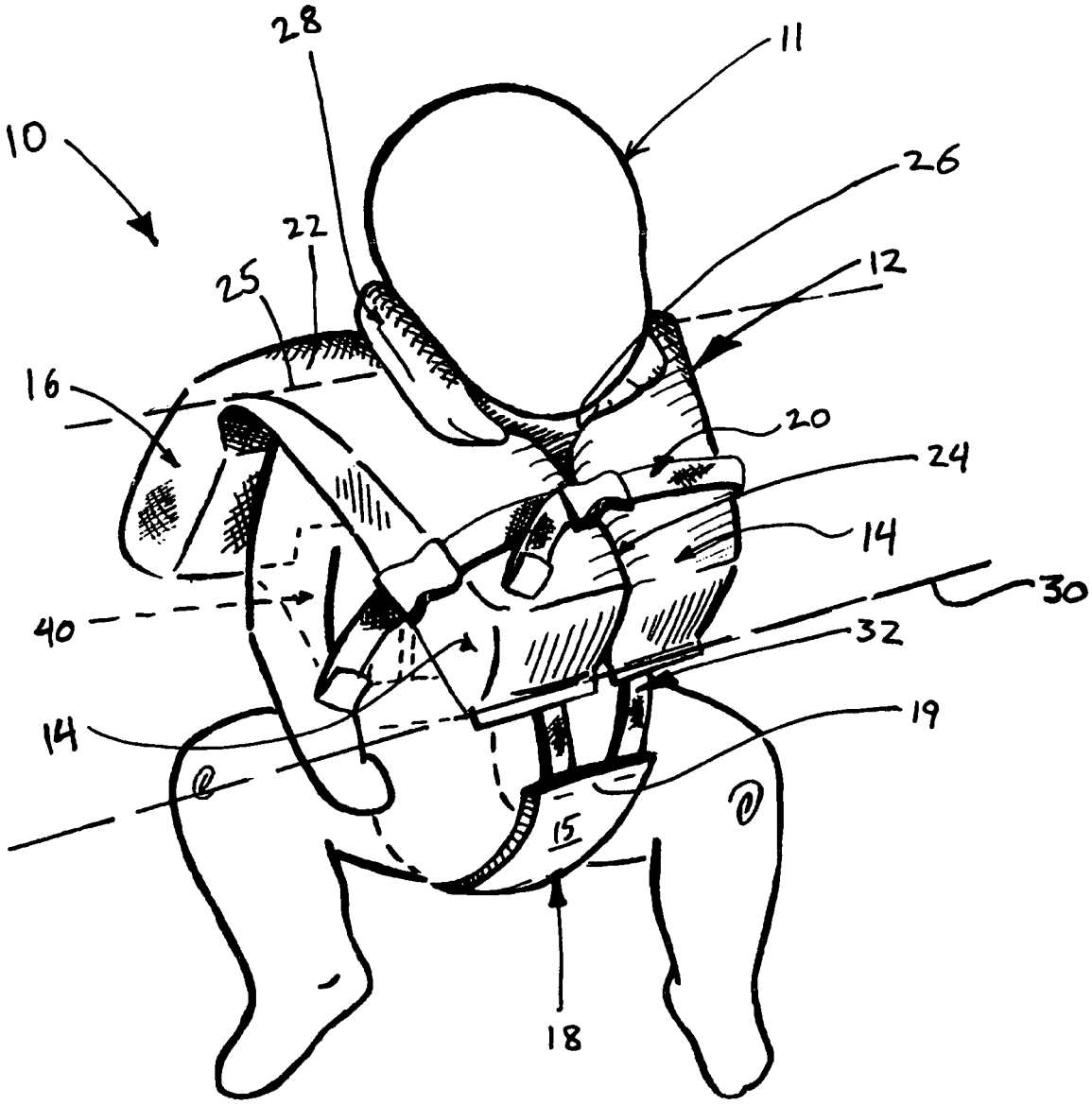
FIG. 1 is a front perspective view of the personal flotation device in accordance with one aspect of the present invention, the flotation device being shown strapped in place on an infant.

Referring to FIG. 1, the PFD 3 is shown attached to an infant 11 for use to keep the infant afloat in a body of water. The PFD 3 is particularly adapted to keep the infant's head well out of the water and to maintain the infant in a substantially vertical floating position in the water. This differs from many children's life jackets of the prior art, which typically aim to maintain the child on his or her back in a slightly reclined floating position. By maintaining the infant in a substantially vertical position when in the water, the child's general awareness of the surroundings is increased, thus keeping them in greater contact, particularly visually, with their environment. This allows the very young infant to become more quickly accustomed to the water and helps makes their swimming experience more enjoyable and less frightening, particularly for a child's first exposure to relatively large bodies of water. The PFD 3 accordingly keeps the infant in a relatively stable vertical position with their head well out of the water. Further, as the PFD 3 doesn't have any arm holes or legs holes, the infant's limbs are able to move freely, ensuring an ease of movement which makes the infant more comfortable in the water.

Referring in more detail to FIG. 1, the PFD 3 includes generally a main flotation member 12 which includes a front flotation portion 14 adapted, when in use, to overlay an upper region of the wearer's chest, and a rear flotation portion 16 which is adapted to overlay an upper region of the wearer's back. The front flotation portion 14 is split into two separate portions by a centrally disposed frontal opening 24 defining the pair of front flotation portions 14 which can be separated and spaced apart for installation of the PFD when the transversal main fastening strap 20 is disengaged. The frontal opening 24 communicates with a generally circular neck receiving opening 26 through which the wearer's head and neck extend when the PFD is in use. The neck receiving opening 26 is at least partially circumscribed by a relatively stiff "anti-shock" collar portion 28 which is adapted to protect and support the sides and rear regions of the wearer's neck, as well as helping to provide support for the infant's head. Very yonng infants, such as those under the age of 7 months, generally have undeveloped neck muscles and therefore their relatively heavy heads require extra support, particularly in a rocking boat or when floating freely in the water. Thus, the protective collar 28 helps support the infant's head and neck in an upright position. The front edges of the protective collar 28 preferably open slightly outwards in order to nevertheless provide sufficient room for the infant's jaw and cheeks while still supporting the neck. The pair of front flotation portions 14 are joined with the rear flotation portion 16 along a transverse top edge 22 which is adapted to overlay the shoulders of the wearer.

Figure 3:
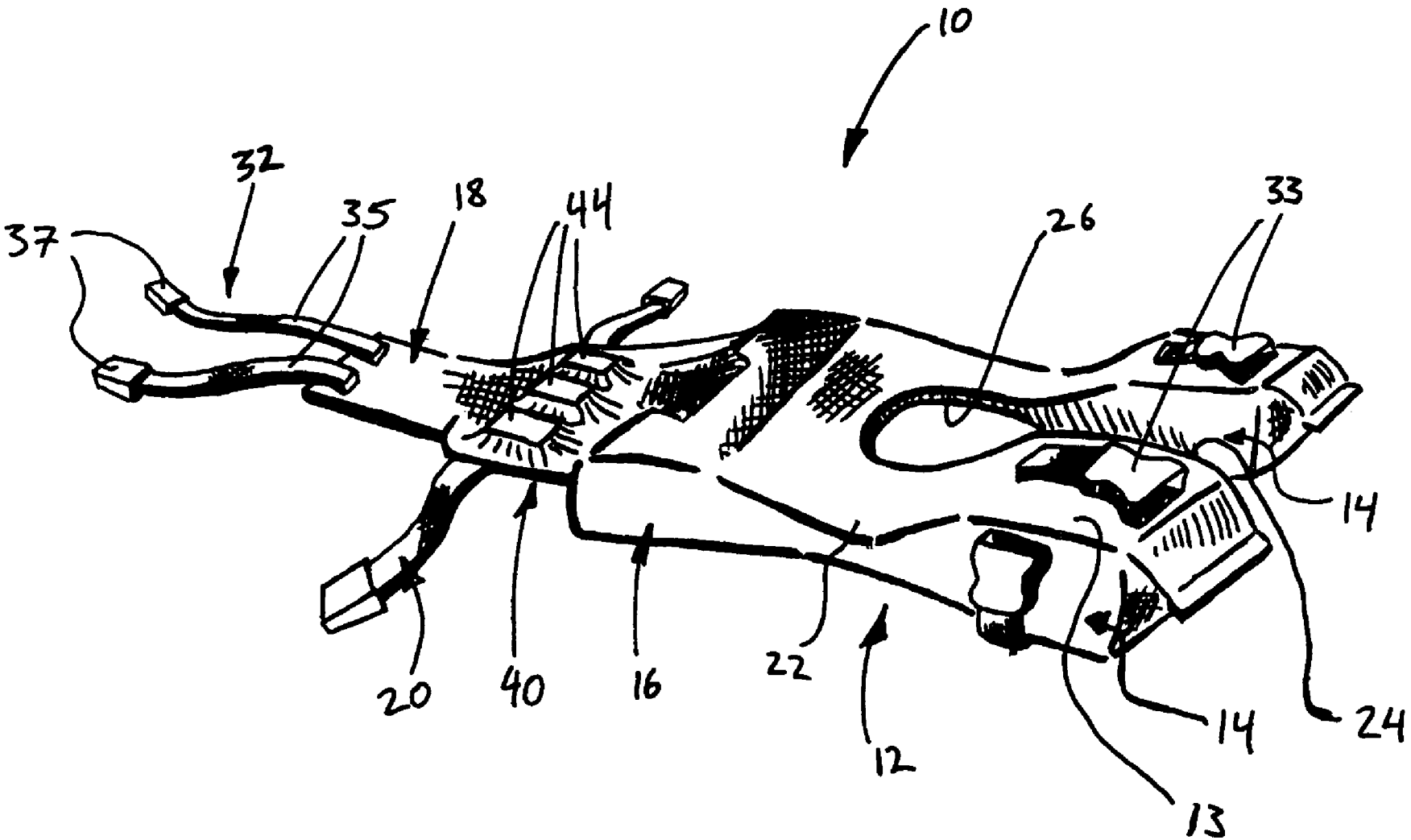
FIG. 3 is a perspective view of the personal flotation device of FIG. 1, shown laid out.
Figure 6A:
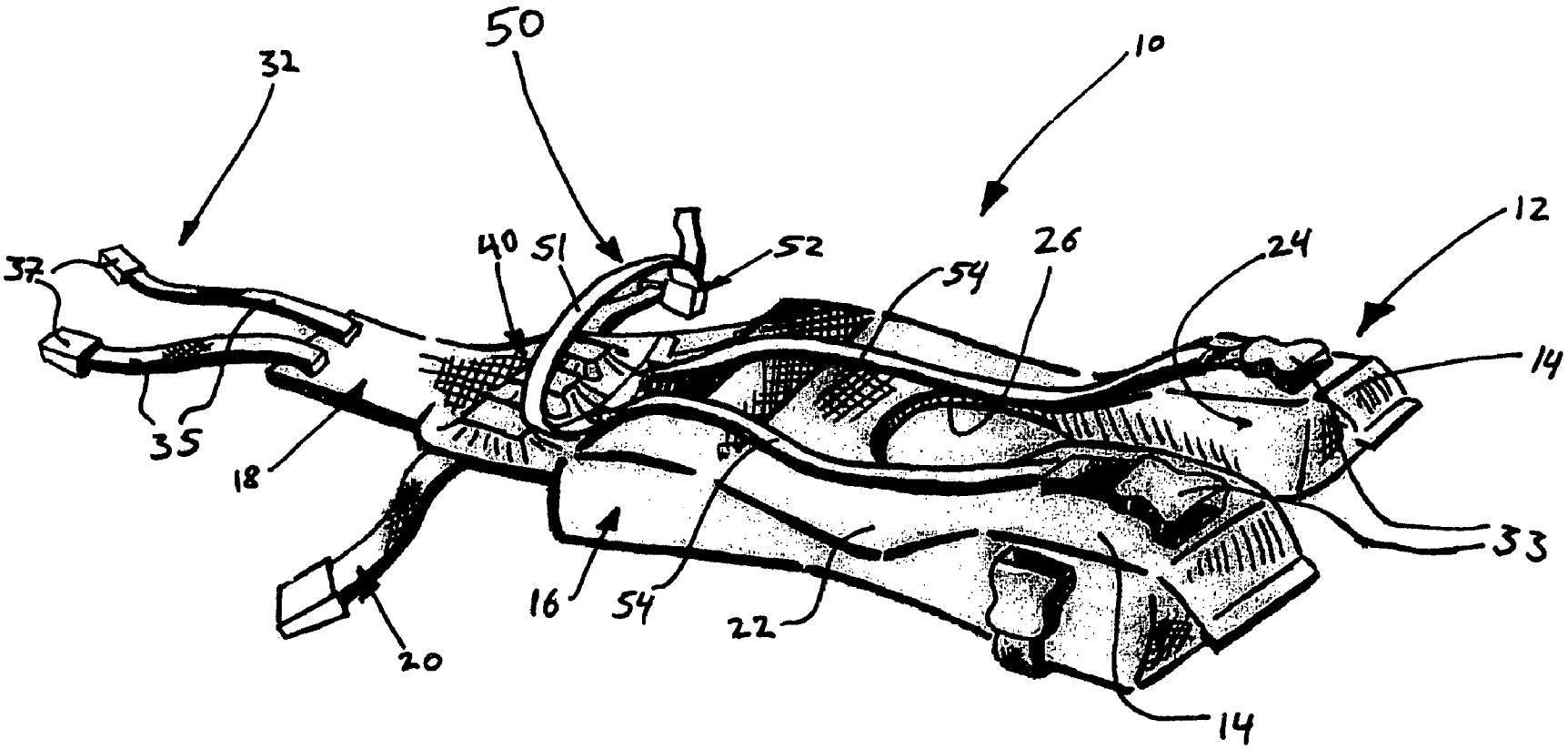
FIG. 6*a* is a perspective view of another embodiment of the personal flotation device of the present invention, shown laid open.

The main flotation member 12 provides most of the buoyancy of the PFD and is preferably made up of a single buoyant structure which comprises the front flotation portions 14 and the rear flotation portion 16 which are integrally joined together along the transverse top edge 22. As best seen in FIGS. 3 and 6*a*, the main flotation member 12 defines a generally truncated triangular perimeter, wherein the rear flotation portion has a transversal width which is greater than a combined transversal width of the front flotation portions 14. Preferably, the transversal width increases from a remote end of the front flotation portion to an opposed remote end of the rear flotation portion.

The transverse top edge 22 located at the intersection of the rear flotation portion 16 and the front flotation portions 14 defines therethrough a transversely extending axis 25 disposed between the front and rear flotation portions and adapted to overlay the shoulders of the wearer. The transverse top edge 22 preferably has less buoyancy generating flotation material therein than said front and rear flotation portions. The rear flotation portion and the front flotation portions respectively extend a first and a second distance away from this transversely extending axis 25, thereby defining lengths of the flotation portions which extend downward over the front and back of the wearer. Preferably, the front flotation portions 14 are longer than the rear flotation portion 16, namely that the second distance is greater then the first distance. Preferably the second distance (of the front flotation portions) is less than twice the first distance (of the rear flotation portion). The front flotation portion defines a first partial buoyancy and said rear flotation portion defines a second partial buoyancy. The first and second partial buoyancies are at least substantially counterbalancing, which helps maintain the user wearing the PFD in a substantially vertical position (i.e. fore-aft) when floating in the water. The first and second partial buoyancies are however more preferably substantially equivalent to each other. Substantially equivalent as used in this sense is intended to mean approximately similar to each other, however it is understood that slight differences between the first and second partial buoyancies can occur while nevertheless permitting the partial buoyancies to counterbalance one another. In contrast, most prior art personal flotation devices are significantly biased towards the rear or the front (typically towards the rear such that the infant is maintained floating on their back), and as such any partial buoyancies provided by the front and rear portions of such prior art devices are drastically different.

The pair of flotation elements of the front flotation portion 14 are joined with the rear flotation portion 16 along the transversely extending axis 25. Thus, the PFD 10 leaves the arms and legs of the wearer completely free to move without obstruction. The PFD is fixed in place on the wearer by at least one fastening strap 20 which has interconnectable first and second strap portions each fixed at the rear ends thereof to a rear part of the PFD, preferably the rear panel portion 40 described in further detail below. The free ends of each of the first and second strap portions are therefore able to extend around the front flotation portions 14 in opposite directions and are fastenable together, preferably at the center of the first flotation portions, by a fastening clip, buckle, or similar strap fastening means.

Figure 2:
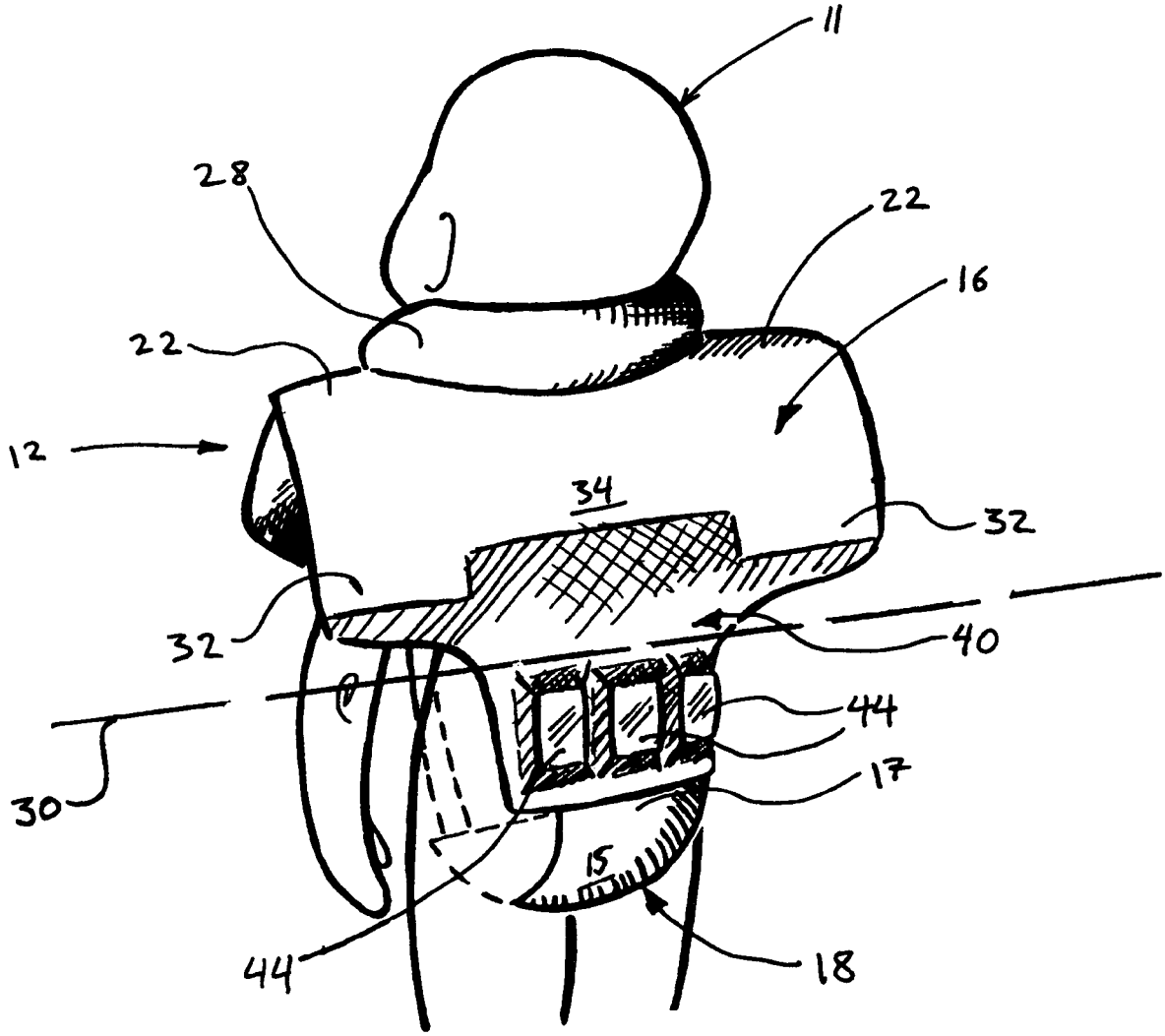
FIG. 2 is a rear perspective view of the personal flotation device of FIG. 1.

A seat portion 18 of the PFD 10 extends between the wearer's legs to interconnect the front and rear parts of the PFD. Accordingly, relative movement of the buoyant main flotation member 12 and the wearer is limited by the seat portion 18 which helps to retain the PFD in place on the infant. As seen in FIGS. 1 and 2, the seat portion 18 includes a panel 15 which has a rear end 17 fixed in place to the rear panel portion 40 and which extends forward between the wearer's legs such that the free end 19 thereof may be releasably fastened to the remote lower ends of the front flotation portions 14 by a fastening means 32. As shown in more detail in FIG. 3, the fastening means 32 for releasably fastening the front end 19 of the seat portion 18 to the front flotation portions 14 includes a pair of straps 35 having clip elements 37 on the ends thereof which are engageable for releasable fastening with corresponding clips 33 disposed on an inner surface 13 of the front flotation portions 14.

The seat portion 18 of the PFD 10 securely maintains the PFD 10 in place on the infant and helps prevent the infant from sliding through the neck opening 26 in the main flotation member 12. This also helps to keep the infant in a seated position within the PFD which, in combination with the features of the PFD which maintain its substantially vertical floating position in the water, help keep the infant in a comfortable and secure position.

Referring back to FIG. 2, the rear panel portion 40 is fixed to the lower ends of the rear flotation portion 16 and extends downward therefrom such that the rear panel portion 40 is adapted to overlay the wearer's lower back. Preferably, the rear panel portion 40 is completely free of buoyancy generating flotation material, however at least any buoyancy provided by the rear panel portion 40 is minimal relative to the rear flotation portion 16 and front flotation portions 14 of the main flotation member 12. Thus, a majority of the buoyancy provided by the PFD 10 is disposed above a horizontally extending reference axis 30 which is located proximate the lower remote ends of the front flotation portions 14 and is adapted to correspond substantially to a center of gravity of the wearer, disposed proximate the navel of the user. Preferably, more than 70% of the buoyancy provided by the PFD 10 is disposed above the horizontally extending reference axis 30. More preferably still, at least about 80% of the buoyancy provided by the PFD of the present invention is disposed above this reference axis. Preferably, at least 80% of the buoyancy provided by the PFD 10 is disposed between the wearer's ears, located near the protective collar 28, and the wearer's thorax, which corresponds approximately to the vertical elevation of the main fastening strap 20.

As seen in FIG. 2, at least one ballast weight 44 is preferably provided on the PFD 10, and is preferably disposed on the rear panel portion 40 thereof below the horizontally extending reference axis 30. In the embodiment depicted in FIGS. 2 and 3, three such ballast weights 44 are provided and integrally formed within the rear panel portion 40, the ballast weights 44 being nevertheless located below the reference axis 30 and proximate the lower back region of the wearer. While the PFD 10 may not comprise any such ballast weights, these are preferably included in order to help maintain the substantially vertical position of the infant in the water. Thus, the low-placed ballast weights counteract the high-placed flotation members, causing a naturally self-righting and self-stabilizing PFD. This is particularly useful for PFDs adapted for use by infants, as very young children tend to have relatively heavy heads and relatively buoyant lower bodies at least partially caused by the relatively high level of fatty tissue in the legs of infants. Further, very young children may often be wearing diapers in the water, which further increase the buoyancy of the lower half of their bodies. This makes for a potentially dangerous natural combination, and therefore a PF having ballast weights 44 located below the reference axis 30 counterbalances the buoyancy of the main flotation member 12 which is disposed relatively high on the wearer. Therefore, the ballast weights 44 help maintain the infant 11 wearing the PFD 10 in a generally vertical position in the water, and further enable reduction of the overall buoyancy and therefore volume of the main flotation member 12. While the ballast weights 44 may be eliminated, to compensate and ensure similar stability the size and width of the flotation portions of the main flotation member would likely have to be increased in order to provide similar stability. Although the ballast weights 44 are preferably fixed in place, a displaceable ballast weight is also possible, for example a solid weight which can slide within a larger pocket enclosed within the rear panel portion or alternatively a pouch filled with a liquid ballast.

As seen in FIG. 2, the rear flotation portion 16 of the main flotation member 12 has a lateral width which is preferably larger than the shoulders of the wearer, and comprises a central portion 34 and larger depending lateral side portions 32 which provide a greater buoyancy than the central portion 34 and are spaced apart and disposed on either side thereof. Alternately, the lateral side portions 32 and the central portion 34 may be of equal size if the lateral side portions are composed of a material having greater buoyancy than that which constitutes the central portion 34. By providing greater buoyancy toward the lateral edges of at least the rear flotation portion 16 of the main flotation member 12, the PFD is further stabilized in a lateral direction. This helps permit the PFD 10 to rapidly return to a central vertical position. Such lateral stability may also be provided without having lateral side portions 32 of greater buoyancy than the central portion 34, by simply extending the width of the flotation portion.

As can be seen in FIGS. 1 and 2, the front and rear flotation portions of the main flotation member 12 are located high up relative to the wearer, such that the buoyant flotation portions are disposed relatively close to the head of the infant 11. Generally, the higher the buoyant flotation members are located, the greater the tendency for the PFD to keep the infant's head out of the water.

Referring now to FIG. 3, the PFD 10 is shown in a fully disassembled or laid out position. The PFD 10 may thus be laid flat on the ground in order to easily permit the PFD to be installed and secured to the infant. Once laid flat as shown in FIG. 3, the infant may then be laid on his or her back in position overtop thereof, such that the infant's bottom is aligned with the seat portion 18. The pair of front flotation members 14 may then be raised up and over the shoulders of the infant and secured to the straps 35 by mating the clip fasteners 37 and 33. The main fastening strap 20 can then be wrapped around the front surface of the front flotation portions 14 and fastened together in place in front of the infant, thereby securing the PFD 10 in place on the infant. All fastening straps may then be further adjusted and tightened as required to ensure a secure and snug fit.

Figure 6B:
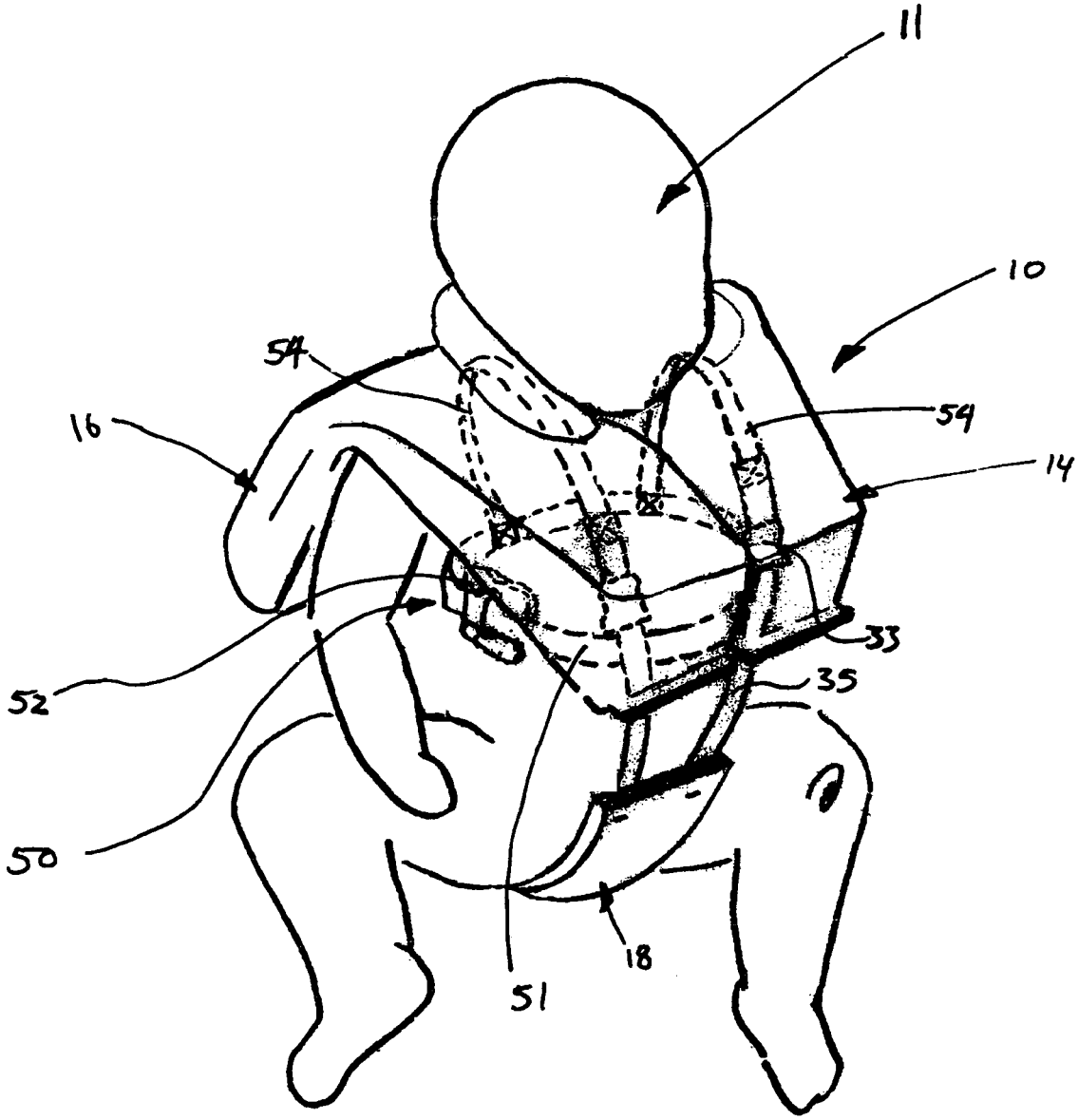
FIG. 6*b* is a perspective view of the personal flotation device of FIG. 6*a*, shown strapped in place on an infant.

As shown in FIGS. 6*a* and 6*b*, in a slight alternate embodiment, the PFD 10 may further comprise an additional internal fastening strap 50, located within the PFD, in order to more securely still fasten the infant in place therewithin. The additional fastening strap 50 is preferably fixed to an inner surface of the rear panel portion 40 and includes at least a transversely extending portion 51 thereof which can be wrapped around the central torso of the infant and fastened in place using a clip member 52. This additional internal fastening strap 50 may be used to provide further assurance that the infant will remain securely in place within the PFD 10 and eliminate any possibility for unwanted movement of the infant therewithin, such as vertical displacement through the neck opening 26. The internally mounted additional or secondary fastening strap 50 therefore permits the PFD 10 to be fastened to the wearer, preferably independently of the main fastening strap 20 on the exterior of the PFD. The interior secondary fastening strap 50 may also include shoulder strap portions 54 which extend upwards from the transverse portion 51 and over the shoulders of the wearer. The shoulder strap portions 54 of the internal fastening strap 50 may be fixed at their remote end to the clip buckle fasteners 33 on the inner surface of the front flotation members 14, thereby simplifying the installation of the fastening strap 50 to the wearer. The main outer fastening strap 20 is not depicted in FIG. 6*b*. While this has been done principally for improved drawing clarity, it nevertheless remains possible that the external main fastening strap 20 may in fact be disposed of when the internal fastening strap 50 provides sufficiently secure attachment to engage the PFD to the wearer. Preferably, however, the main fastening strap 20 is provided regardless.

Figure 4:
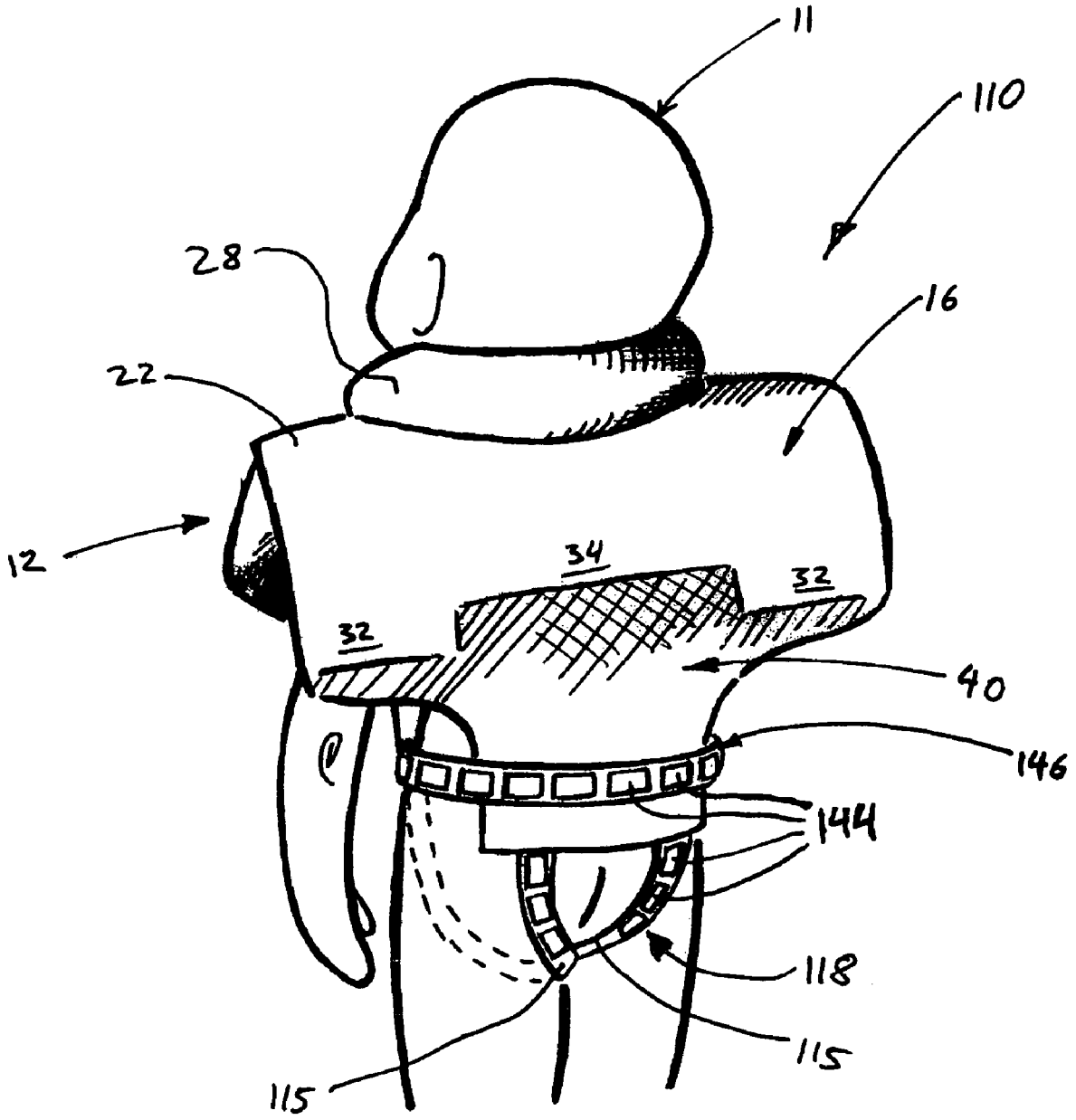
FIG. 4 is a rear perspective view of a personal flotation device in accordance with another embodiment of the present invention.
Figure 5:
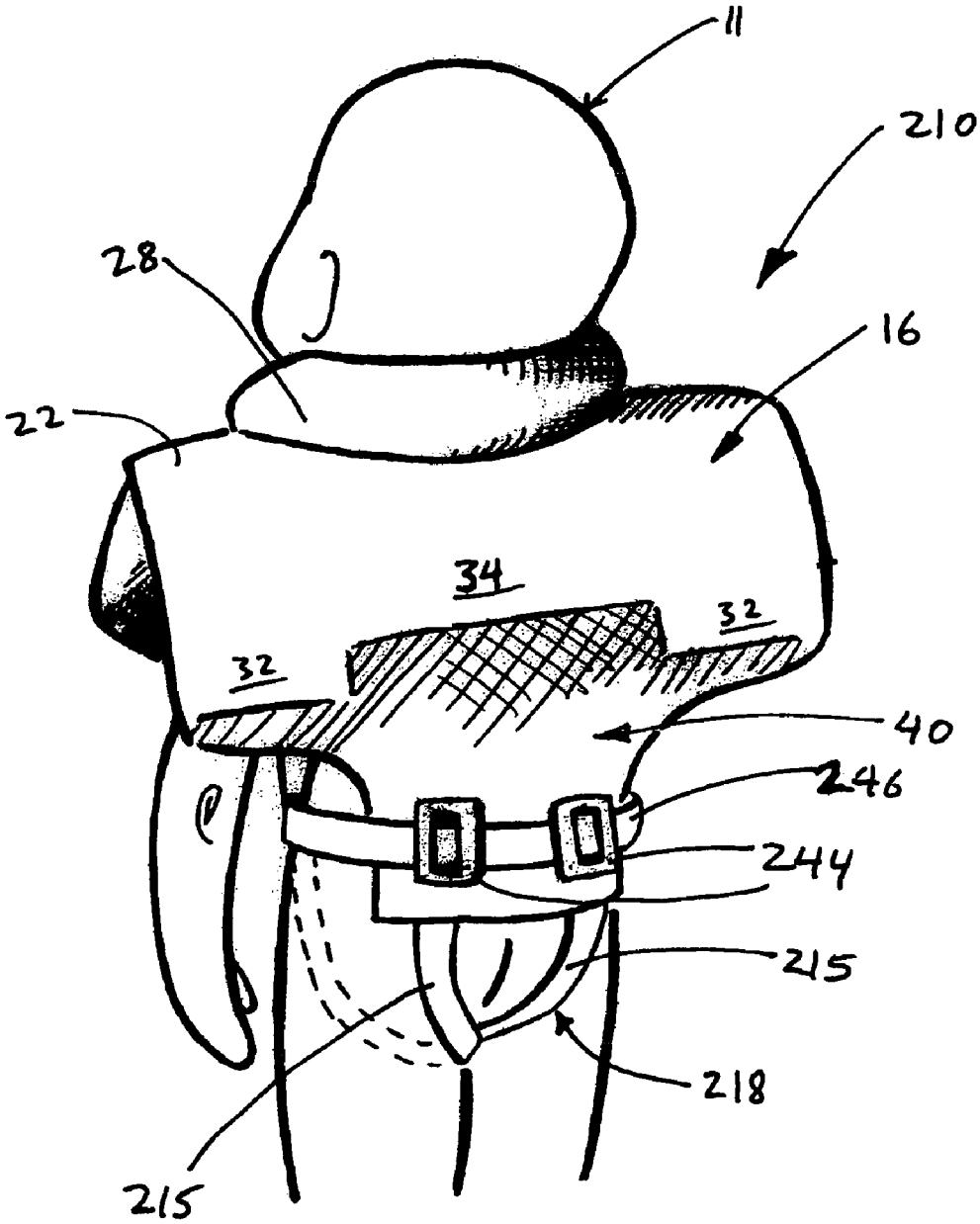
FIG. 5 is a rear perspective view of a personal flotation device in accordance with yet another embodiment of the present invention.

Referring now to FIGS. 4 and 5 depicting alternate embodiments of the present invention, namely PFDs 110 and 210 respectively which are similar to the PFD 10 previously described, but which have alternate ballast weight configurations. Particularly, FIG. 4 depicts a PFD 110 which includes a horizontal waist belt 146 having a plurality of small ballast weights 144 thereabout. The weight belt 144 may be fastened to the rear panel portion 40 at the rear of the PFD and may in fact serve as the main fastening strap which circumscribes the entire PFD and fastens at the front thereof to secure the device in place on the wearer. In place of the relatively wide material strip 15 of the seat portion 18 of the PFD 10, the seat portion 118 of the PFD 100 comprises instead a pair of straps 115, which are spaced apart and fastened to the rear panel portion 40 and extend between the legs of the wearer. The straps 115 have forward ends thereof which are releasably fastenable to the front flotation portions of the main flotation member 12. A plurality of ballast weights 144 may also be disposed along the seat straps 115 of the seat portion 118.

FIG. 5 depicts an alternate embodiment, wherein the PFD 210 includes a weight belt 246 which extends around the PFD and includes a plurality of large ballast weights 244 thereon. The ballast weights 244 may be displaceable along the belt strap 246 such that the location of the weight can be disposed as required in order to best stabilize the wearer when floating in the water. The seat portion 218 of the PFD 210 similarly includes a pair of seat straps 215 which are fastened to the rear panel portion 40 and extend forward between the user's legs for engagement with the front flotation portions. The seat straps 215 are generally free of ballast weights, which are all disposed on the weight belt 246 in this embodiment.

Figure 7:
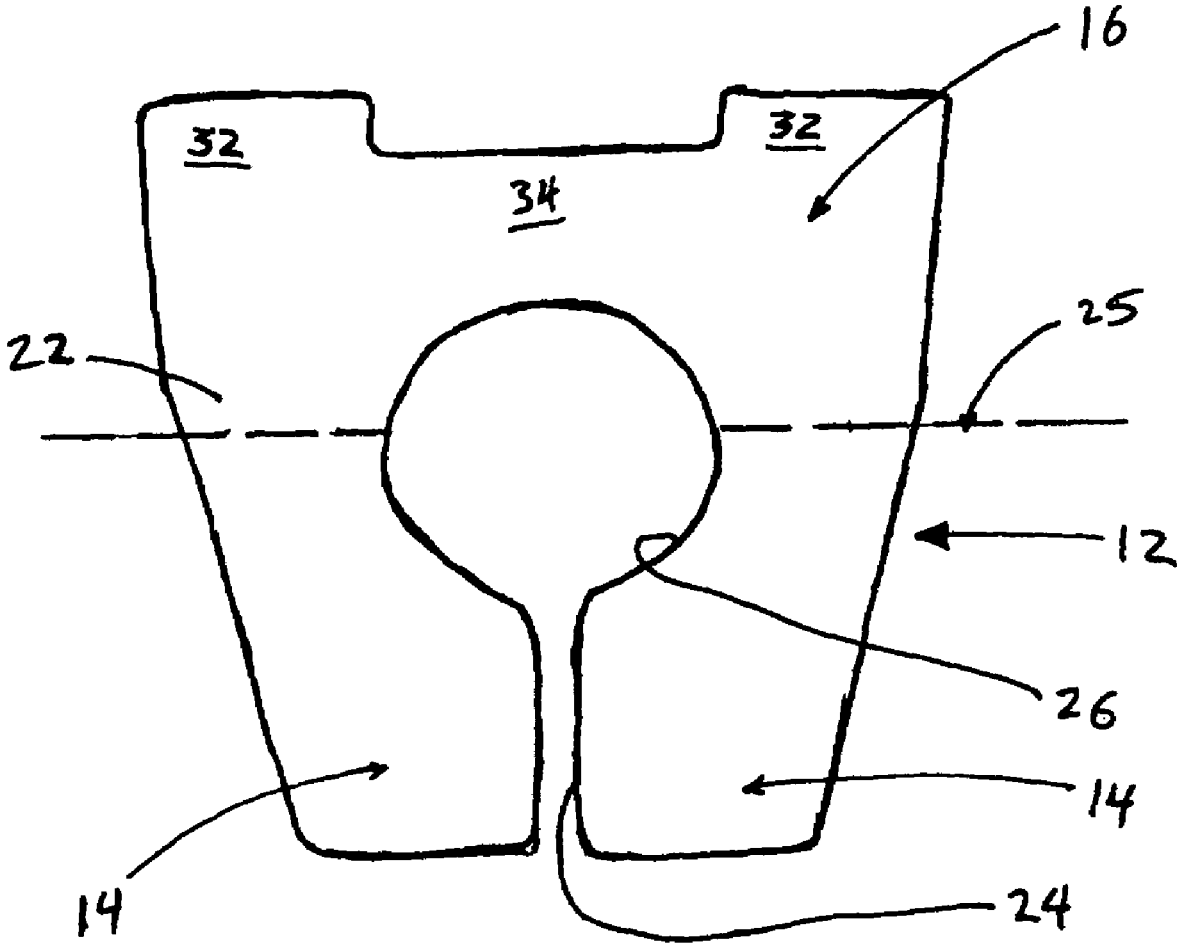
FIG. 7 is a schematic top plan view of a main flotation member of the personal flotation device of FIG. 1.

Referring to FIG. 7, the main flotation member 12 is schematically depicted such that its generally triangular perimeter shape is clearly evident, in which the combined transversal width of the front flotation portion 14 is less than that of the rear flotation portion 16, and the transversal width generally gradually increases from front to back thereof. As described above, this wider rear portion of the main flotation member permits improved stability in the water. The transversely extending axis 25, which passes through the transverse top edge 22 defined at the junction of the front flotation portions 14 and the rear flotation portion 16, intersects the neck receiving opening 26 and is adapted to overlay the shoulders of the wearer. The main flotation member 12, folded generally along the transversely extending axis 25 when in place on a wearer as depicted in FIG. 1, therefore generally forms a "shoulder-pad" type of structure which covers the wearer's shoulders, upper back region and upper thoracic region. Preferably, a floating foam material comprises the buoyancy generating material within the main flotation member 12, which is preferably formed of a single piece to create the main flotation member 12. The front and rear flotation portions 14 and 16 may however have a greater volume, and therefore provide more buoyancy, than the central regions of the main flotation member therebetween along the transverse top edge 22 thereof.

The above description is meant to be exemplary only, and one skilled in the art will recognize that changes may be made to the embodiments described without department from the scope of the invention disclosed. Still other modifications which fall within the scope of the present invention will be apparent to those skilled in the art, in light of a review of this disclosure, and such modifications are intended to fall within the appended claims.

The invention claimed is:

1. A personal flotation device comprising a buoyant main flotation member fastenable to a wearer and including a rear flotation portion adapted to overlay an upper region of the wearer's back and a front flotation portion adapted to overlay an upper region of the wearer's chest, said rear flotation portion and said front flotation portion respectively extending a first and a second distance away from a transversely extending top edge of the personal flotation device intermediately disposed between said front and rear flotation portions and adapted to overlay shoulders of the wearer, the front flotation portion including a pair of flotation elements which are separated by a frontal opening extending said second distance of said front flotation portion and which communicates with a neck receiving opening defined along said transversely extending top edge, said rear flotation portion having a transversal width greater than that of said front flotation portion, said transversal width increasing from a remote end of said front flotation portion to an opposed remote end of said rear flotation portion.

2. The personal flotation device as defined in claim 1, wherein said front flotation portion defines a first partial buoyancy and said rear flotation portion defines a second partial buoyancy, the first and second partial buoyancies being substantially counterbalancing such that the wearer is maintained substantially vertically when floating in water.

3. The personal flotation device as defined in claim 2, wherein the first and second partial buoyancies are substantially equivalent.

4. The personal flotation device as defined in claim 1, wherein said second distance is greater than said first distance.

5. The personal flotation device as defined in claim 4, wherein said second distance is less than twice said first distance.

6. The personal flotation device as defined in claim 1, wherein the front flotation portion is joined with said rear flotation portion along said transversely extending top edge.

7. The personal flotation device as defined in claim 1, wherein a rear panel portion is fixed to said rear flotation portion and extends therefrom for overlaying the wearer's lower back, the rear panel portion being substantially free of buoyant material relative to said main flotation member.

8. The personal flotation device as defined in claim 7, further comprising at least one ballast weight disposed on said rear panel portion.

9. The personal flotation device as defined in claim 1, wherein said rear flotation portion has lateral side portions spaced apart by a central portion, said lateral side portions producing a greater buoyancy than said central portion and stabilizing the personal flotation device in a lateral direction.

10. The personal flotation device as defined in claim 9, wherein said lateral side portions define a greater volume than said central portion.

11. The personal flotation device as defined in claim 1, wherein a seat portion extends between said front flotation portion and said rear flotation portion and is adapted to pass between the wearer's legs, the seat portion having a fixed end thereof permanently engaged with one of said front and rear flotation portions and an opposed free end having a fastening member thereon for removably fastening said free end to the other of said front and rear flotation portions.

12. The personal flotation device as defined in claim 11, wherein said neck receiving opening is sized such that a looser fit with the wearer's neck is provided, said seat portion ensuring that the personal flotation device is securely engaged to the wearer.

13. The personal flotation device as defined in claim 1, wherein said buoyant main flotation member defines a buoyancy distribution such that a majority of buoyancy provided by said personal flotation device is disposed above a horizontally extending reference axis which corresponds substantially to a center of gravity of the wearer.

14. The personal flotation device as defined in claim 13, wherein the horizontally extending reference axis is disposed proximate to lower ends of said front flotation portions which are adapted to be disposed above a navel of the wearer.

15. The personal flotation device as defined in claim 13, wherein more than 70% of the buoyancy provided by said personal flotation device is disposed above said reference axis.

16. The personal flotation device as defined in claim 1, wherein said neck receiving opening is at least partially circumscribed by a neck-supporting collar portion protruding from said front and rear flotation members for supporting the wearer's head and neck in an upright position.

17. The personal flotation device as defined in claim 1, wherein at least one fastening strap is releasably fastenable to retain the main flotation member in place on the wearer, said at least one fastening strap including a main fastening strap having at least a portion thereof fixed to one of said front and rear flotation portions.

18. The personal flotation device as defined in claim 1, wherein at least one fastening strap is releasably fastenable to retain the main flotation member in place on the wearer, said at least one fastening strap including an inner fastening strap disposed within the personal flotation device and fixed to an inner surface thereof, the inner fastening strap being adapted to extend around at least a portion of the wearer and being fastenable to retain the personal flotation device in place thereon.

19. The personal flotation device as defined in claim 1, wherein said front flotation member and said rear flotation member are integrally joined along said transverse top edge to form a single main flotation member.

20. A personal flotation device comprising a buoyant main flotation member fastenable to a wearer and including a rear flotation portion adapted to overlay an upper region of a wearer's back and a front flotation portion adapted to overlay an upper region of a wearer's chest, the front flotation portion including a pair of flotation elements which are separated by a frontal opening extending a complete length of said front flotation portion and which communicates with a neck receiving opening defined along a transversely extending top edge of the personal flotation device, said rear flotation portion being comprised of central and lateral side portions, the lateral side portions being located on either side of the central portion and providing greater buoyancy toward lateral edges of the rear flotation portion than said central portion, said lateral side portions stabilizing the personal flotation device in a lateral direction, and wherein said rear flotation portion has a transversal width greater than that of said front flotation portion, said transversal width increasing from a remote end of said front flotation portion to an opposed remote end of said rear flotation portion.

21. The personal flotation device as defined in claim 20, wherein said lateral side portions of said rear flotation portion define a greater volume than said central portion thereof.

22. The personal flotation device as defined in claim 20, wherein at least one ballast weight is disposed on a portion of said personal flotation device below a horizontally extending reference axis of the personal flotation device which corresponds substantially to a center of gravity of the wearer.

23. The personal flotation device as defined in claim 22, wherein said buoyant main flotation member defines a buoyancy distribution such that a majority of buoyancy provided by said personal flotation device is disposed above said horizontally extending reference axis.

24. A personal flotation device comprising a buoyant main flotation member fastenable to a wearer and including a rear flotation portion adapted to overlay an upper region of a wearer's back and a front flotation portion adapted to overlay an upper region of a wearer's chest, said rear flotation portion and said front flotation portion respectively extending a first and a second distance away from a transversely extending top edge of the personal flotation device intermediately disposed between said front and rear flotation portions and adapted to overlay shoulders of the wearer, the front flotation portion including a pair of flotation elements which are separated by a frontal opening extending said second distance of said front flotation portion and which communicates with a neck receiving opening defined along said transversely extending top edge, said front flotation portion having an upper transversal width proximate said transversely extending top edge that is greater than a lower transversal width proximate a remote end of said front flotation portion, wherein a seat portion extends between said front flotation portion and said rear flotation portion and is adapted to pass between the wearer's legs, the seat portion having a fixed end thereof permanently engaged with one of said front and rear flotation portions and an opposed free end having a fastening member thereon for removably fastening said free end to the other of said front and rear flotation portions.

25. The personal flotation device as defined in claim 24, wherein said buoyant main flotation member defines a buoyancy distribution such that a majority of buoyancy provided by said personal flotation device is disposed above a horizontally extending reference axis of the personal flotation device which corresponds substantially to a center of gravity of the wearer, and wherein at least one ballast weight is disposed on said personal flotation device below said horizontally extending reference axis such as to counterbalance said majority of buoyancy.

26. The personal flotation device as defined in claim 24, wherein said rear flotation portion is comprised of a central and two lateral side portions, the lateral side portions being located on either side of the central portion and providing greater buoyancy toward lateral edges of the rear flotation portion than said central portion, said lateral side portions stabilizing the personal flotation device in a lateral direction.

27. The personal flotation device as defined in claim 26, wherein said central and lateral side portions define a stepped rear edge of the rear flotation portion.

28. The personal flotation device as defined in claim 26, wherein said lateral side portions define a greater volume than said central portion.

29. The personal flotation device as defined in claim 24, wherein said neck receiving opening is at least partially circumscribed by a neck-supporting collar portion protruding from said front and rear flotation members for supporting the wearer's head and neck in an upright position.

30. The personal flotation device as defined in claim 24, wherein more than 70% of the buoyancy provided by said personal flotation device is disposed above said reference axis.

* * * * *